US008777007B2

(12) United States Patent
Chen et al.

(10) Patent No.: US 8,777,007 B2
(45) Date of Patent: Jul. 15, 2014

(54) PACKAGING BOX FOR LIQUID CRYSTAL GLASS

(75) Inventors: Shihhsiang Chen, Shenzhen (CN); Yicheng Kuo, Shenzhen (CN); Jiahe Cheng, Shenzhen (CN)

(73) Assignee: Shenzhen China Star Optoelectronics Technology Co., Ltd., Shenzhen (CN)

( * ) Notice: Subject to any disclaimer, the term of this patent is extended or adjusted under 35 U.S.C. 154(b) by 24 days.

(21) Appl. No.: 13/511,395

(22) PCT Filed: Apr. 23, 2012

(86) PCT No.: PCT/CN2012/074517

§ 371 (c)(1),
(2), (4) Date: May 23, 2012

(87) PCT Pub. No.: WO2013/152524

PCT Pub. Date: Oct. 17, 2013

(65) Prior Publication Data

US 2013/0270139 A1 Oct. 17, 2013

(30) Foreign Application Priority Data

Apr. 13, 2012 (CN) ..... 2012 1 0108869

(51) Int. Cl.
*B65D 85/48* (2006.01)

(52) U.S. Cl.
USPC ..... 206/454; 206/586

(58) Field of Classification Search
USPC ..... 206/711, 723, 455, 565, 523, 586, 561, 206/454
See application file for complete search history.

(56) References Cited

U.S. PATENT DOCUMENTS

| | | | | |
|---|---|---|---|---|
| 5,296,893 | A * | 3/1994 | Shaw et al. | 355/75 |
| 5,314,068 | A * | 5/1994 | Nakazato et al. | 206/454 |
| 6,591,987 | B2 * | 7/2003 | Wu et al. | 206/454 |
| 7,644,820 | B2 * | 1/2010 | Hohne et al. | 206/523 |
| 8,231,005 | B2 * | 7/2012 | Kolbow et al. | 206/710 |
| 2005/0155904 | A1 | 7/2005 | Chen | |
| 2007/0062839 | A1 * | 3/2007 | Patterson | 206/523 |
| 2007/0227935 | A1 | 10/2007 | Saito | |

FOREIGN PATENT DOCUMENTS

| | | | |
|---|---|---|---|
| CN | 201128567 | Y | 10/2008 |
| CN | 201419873 | Y | 3/2010 |
| CN | 201597821 | U | 10/2010 |
| CN | 202089455 | U | 12/2011 |
| JP | 11-240594 | A | 9/1999 |
| JP | 2002-324820 | A | 11/2002 |
| JP | 2009-269610 | A | 11/2009 |

OTHER PUBLICATIONS

Xie Chen, the first office action, Jul. 2013, CN.

* cited by examiner

*Primary Examiner* — David Fidei
(74) *Attorney, Agent, or Firm* — Na Xu

(57) ABSTRACT

The invention relates to the field of packaging, and more particularly to a packaging box for liquid crystal glass. The packaging box for liquid crystal glass includes a box body; the box body is internally provided with buffer blocks which are made of material different from that of the box body and have buffer performance superior to that of the box body. The packaging box for liquid crystal glass of the invention is of a separated structure, the box body and the buffer blocks are respectively made of different materials, the buffer blocks are made of material with good buffer performance, and the box body is mainly used for fixing the buffer blocks and ensuring the strength of the whole box body; thus, the box body is made of ordinary plastic material and injection molded without being made of expanded buffer material with buffer effect and high cost, thereby reducing the cost of the packaging box.

4 Claims, 2 Drawing Sheets

PACKAGING BOX FOR LIQUID CRYSTAL GLASS

TECHNICAL FIELD

The invention relates to the field of packaging, and more particularly to a packaging box for liquid crystal glass.

BACKGROUND

Conventional liquid crystal display (LCD) devices employ various glass substrates. As a brittle material, glass is easily broken and then scrapped when being knocked or shaken by external force. Even the friction between glass substrates possibly causes the glass substrates to be scratched or the circuits on the glass substrates to be damaged. Therefore, how to safely and effectively transport liquid crystal glass becomes a crucial issue.

In the prior art, the frequently-used packaging method is that: a plurality of liquid crystal glass are stacked and then put in a packaging box, and buffer sheets are arranged among the liquid crystal glass. The packaging box is generally made of expanded polypropylene (EPP), expanded polyethylene (EPE), expanded polystyrene (EPS), etc. The expanded materials have the advantages of better buffer performance, certain hardness, no drop of powdered scraps, and no need of worrying about affecting the environment of the dust-free room. However, the expanded materials are expensive, which don't favor the reduction of packaging cost.

SUMMARY

In view of the above-described problems, the aim of the invention is to provide a packaging box for liquid crystal glass which is made of different materials and has low cost.

A technical scheme of the invention is that: a packaging box for liquid crystal glass comprises a box body; the box body is internally provided with buffer blocks which are made of material different from that of the box body and have buffer performance superior to that of the box body, and the buffer blocks are arranged on the four corners inside the box body and the middle part inside the side wall of the box body. The box body is made of acrylonitrile butadiene styrene (ABS) or high-density polyethylene (HDPE) and is injection molded, and the buffer blocks are made of EPP. The inner side of the box body is provided with slots, the buffer blocks are provided with clamping parts, and the clamping parts are inserted in the slots and fixed on the box body. The inner wall of the box body is provided with L-shaped clamping arms, each pair of the L-shaped clamping arms create a slot, the buffer block(s) is in a step shape, the wider part of the buffer block is inserted in the slot, and the narrower part of the buffer block is protruded from the slot. The bottom of the box body is provided with trays, and buffer springs are arranged between the box body and the trays. The buffer springs are arranged on the box body and integratedly injection molded together with the box body, and the buffer springs are distributed in multiple positions of the bottom of the box body. The trays are further provided with containing grooves for containing the ends of the buffer springs, the surfaces of the trays around the containing grooves are downwards depressed, and the top outer surfaces of the containing grooves are flush with the plane of the trays.

Another technical scheme of the invention is that: a packaging box for liquid crystal glass comprises a box body; the box body is internally provided with buffer blocks which are made of material different from that of the box body and have buffer performance superior to that of the box body.

Preferably, the buffer blocks are arranged on the four corners inside the box body and used for corner positioning of the liquid crystal glass.

Preferably, the buffer blocks are arranged on the meddle part inside the side wall of the box body. Thus, the sides of the liquid crystal glass are well positioned to prevent shake.

Preferably, the box body is made of ABS or HDPE and is injection molded, and the buffer blocks are made of EPP. Because the box body is not made of expanded buffer material with buffer effect and high cost, the cost of the packaging box is reduced.

Preferably, the inner side of the box body is provided with slots, the buffer blocks are provided with clamping parts, and the clamping parts are inserted in the slots and fixed on the box body.

Preferably, the inner wall of the box body is provided with L-shaped clamping arms, each pair of the L-shaped clamping arms create a slot, the buffer block(s) is in a step shape, the wider part of the buffer block is inserted in the slot, and the narrower part of the buffer block is protruded from the slot. Because the box body is injection molded, the L-shaped clamping arms are easily arranged on the inner wall of the box body to firmly fix the buffer blocks on the box body, and are conveniently and quickly assembled.

Preferably, the bottom of the box body is provided with trays, and buffer springs are arranged between the box body and the trays. The buffer springs support the trays to enable the trays to form larger buffer space in the upward and downward directions and obtain better buffer effect.

Preferably, the buffer springs are arranged on the box body and integratedly injection molded together with the box body. The buffer springs are reliably fixed and are difficult to fall off and lose, thereby avoiding affecting the balance of the trays.

Preferably, the buffer springs are distributed in multiple positions of the bottom of the box body.

Preferably, the trays are further provided with containing grooves for containing the ends of the buffer springs, the surfaces of the trays around the containing grooves are downwards depressed, and the top outer surfaces of the containing grooves are flush with the plane of the trays. The containing grooves are used for ensuring the accurate alignment of the trays and the buffer springs, and guiding the buffer springs, to prevent the buffer springs from deviating from the axis when being compressed. The surfaces of the trays around the containing grooves are downwards depressed, and then the top outer surfaces of the containing grooves are flush with the plane of the trays; thus, the planeness of the trays is not affected.

Advantages of the invention are summarized below: the packaging box for liquid crystal glass of the invention is of a separated structure, the box body and the buffer blocks are respectively made of different materials, the buffer blocks are made of material with good buffer performance, and the box body is mainly used for fixing the buffer blocks and ensuring the strength of the whole packaging box; thus, the box body is made of ordinary plastic material and is injection molded without being made of expanded buffer material with buffer effect and high cost, thereby reducing the cost of the packaging box.

Figure 1:
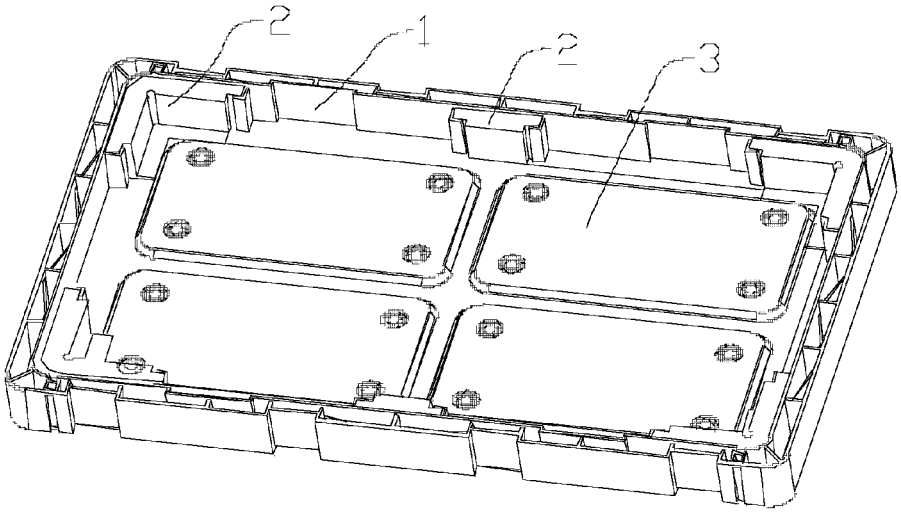
FIG. 1 is a structure diagram of a packaging box for liquid crystal glass of the invention.
Figure 2:
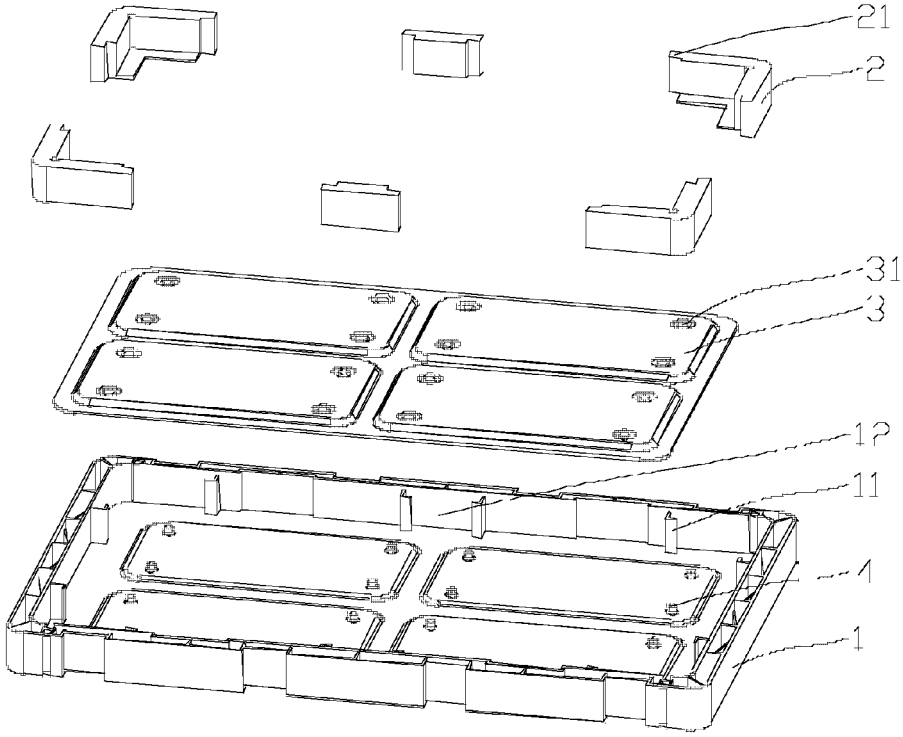
FIG. 2 is a disassembly diagram of a packaging box for liquid crystal glass of the invention.
Figure 3:
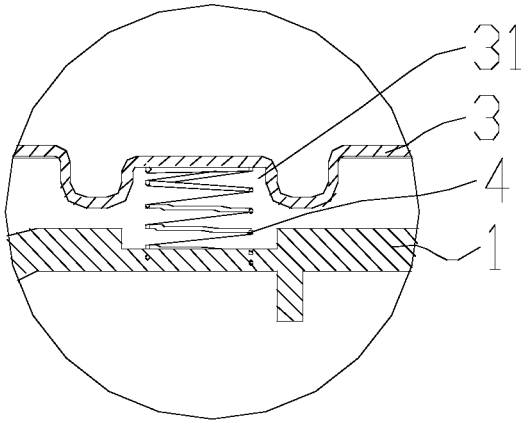
FIG. 3 is a structure diagram of the assembly of of a box body, a buffer spring and a tray of the invention.

Legends: 1. box body; 11. L-shaped clamping arm; 12.slot; 2. buffer block; 21. clamping part; 3.tray; 31.containing groove; 4. buffer spring.

DETAILED DESCRIPTION

The invention provides a packaging box for liquid crystal glass, comprising a box body 1; the box body 1 is internally provided with buffer blocks 2 which are made of material different from that of the box body 1.

The packaging box for liquid crystal glass of the invention is of a separated structure, the box body 1 and the buffer blocks 2 are respectively made of different materials, the buffer performance of the buffer blocks 2 is superior to that of the box body 1, the buffer blocks 2 are made of material with good buffer performance, such as EPP, EPE, EPS, etc., and the box body 1 is mainly used for fixing the buffer blocks 2 and ensuring the strength of the whole packaging box; thus, the box body 1 is injection molded by ordinary plastic material such as ABS, HDPE, etc. Because the box body 1 is not made of expanded buffer material with buffer effect and high cost, the cost of the packaging box is reduced.

In the example, the buffer blocks 2 are arranged on the four corners inside the box body 1, and the middle part inside the side wall of the box body 1 is also provided with buffer blocks 2. Thus, the liquid crystal glass is better positioned on the corners and sides to prevent shake. Both the side surfaces and the bottom surfaces of the buffer blocks 2 play a buffer role, and both positioning by corners and positioning by sides are feasible positioning methods.

In the example, the inner wall of the box body 1 is provided with L-shaped clamping arms 11, each pair of the L-shaped clamping arms 11 create a slot 12, the buffer block(s) 2 is provided with a clamping part 21, the clamping part 21 is inserted in the slot 12, and the buffer block 2 is fixed on the box body 1. The buffer block 2 here is in a step shape, the wider part of the buffer block 2 is inserted in the slot 12, and the narrower part of the buffer block 2 is protruded from the slot 12. Because the box body 1 is injection molded, the L-shaped clamping arms 11 are easily arranged on the inner wall of the box body 1 to firmly fix the buffer blocks 2 on the box body 1, and are conveniently and quickly assembled.

In the example, the bottom of the box body 1 is provided with trays 3, and buffer springs 4 are arranged between the box body 1 and the trays 3. The buffer springs 4 are arranged in multiple positions of the bottom of the box body 1, and the buffer springs 4 support the trays 3 to enable the trays 3 to form larger buffer space in the upward and downward directions and obtain better buffer effect. The aim of arranging the buffer springs 4 on the four corners and the middle part of the box body 1 is to provide balanced buffer force to the trays 3. The buffer springs 4 arranged on the middle part have a support function to the middle part of the trays 3, thereby reducing the requirement to the overall strength of the trays 3.

In the example, the buffer springs 4 are arranged on the box body 1 and are integratedly injection molded together with the box body 1, and the buffer springs 4 are reliably fixed and are not easy fall off and lose, thereby avoiding affecting the balance of the trays 3. To ensure the accurate alignment of the trays 3 and the buffer springs 4, containing grooves 31 for containing the ends of the buffer springs 4 are specially arranged in the trays 3, and the surfaces of the trays around the containing grooves 31 are downwards depressed to enable the top outer surfaces of the containing grooves 31 to be flush with the plane of the trays; thus, the planeness of the plane of the trays 3 is not affected. The containing grooves 31 are further used for guiding the buffer springs 4, to prevent the buffer springs 4 from deviating from the axis when being compressed, and then the top outer surfaces of the containing grooves 31 are flush with the plane of the trays; therefore, the planeness of the plane of the trays 3 is not affected.

The invention is described in detail in accordance with the above contents with the specific preferred examples. However, this invention is not limited to the specific examples. For the ordinary technical personnel of the technical field of the invention, on the premise of keeping the conception of the invention, the technical personnel can also make simple deductions or replacements, and all of which should be considered to belong to the protection scope of the invention.

We claim:

1. A packaging box for liquid crystal glass, comprising: a box body made of a first material; wherein said box body is internally provided with buffer blocks which are made of a second material different from the first material and the second material has buffer performance superior to the first material, and said buffer blocks are arranged on four corners inside said box body and middle part inside side wall of said box body; said box body is made of ABS or HDPE and is injection molded, and said buffer blocks are made of EPP; the inner side of said box body is provided with slots, said buffer blocks are provided with clamping parts, and said clamping parts are inserted in said slots and fixed on said box body; the inner wall of said box body is provided with L-shaped clamping arms, each pair of said L-shaped clamping arms create a slot, each buffer block is in a step shape, a wider part of said buffer block is inserted in said slot, and a narrower part of said buffer block protrudes from said slot; trays are arranged below the said box body, and buffer springs are arranged between said box body and said trays; said buffer springs are arranged on said box body, and said buffer springs are distributed in multiple positions of the bottom of said box body; said trays are further provided with containing grooves for containing the ends of said buffer springs, surfaces of said trays around said containing grooves are downwards depressed, and top outer surfaces of said containing grooves are flush with the plane of said trays.

2. A packaging box for liquid crystal glass, comprising: a box body made of a first material; wherein said box body is internally provided with buffer blocks which are made of a second material different from the first material and the second material has buffer performance superior to the first material, each buffer block is step-shaped including a wide part and a narrow part, a plurality of clamping parts are arranged on inner wall of the box body, and each pair of the clamping parts form a engaging groove to engage the wide part of one buffer block and the narrow part protrudes out the engaging groove, wherein trays are arranged below the said box body, and buffer springs are arranged between said box body and said trays.

3. The packaging box for liquid crystal glass of claim 2, wherein said buffer springs are distributed in multiple positions of the bottom of said box body.

4. The packaging box for liquid crystal glass of claim 2, wherein said trays are further provided with containing grooves for containing the ends of said buffer springs, surfaces of the trays around said containing grooves are downwards depressed, and the top outer surfaces of said containing grooves are flush with the plane of said trays.

* * * * *